US005211315A

United States Patent [19]

Geier

[11] Patent Number: 5,211,315

[45] Date of Patent: May 18, 1993

[54] SPRAYER DEVICE COMPRISING A TRIGGER LEVER

[75] Inventor: Adalberto Geier, Villazzano, Italy

[73] Assignee: Coster Tecnologie Speciali S.p.A., Italy

[21] Appl. No.: 915,414

[22] Filed: Jul. 14, 1992

[30] Foreign Application Priority Data

Aug. 30, 1991 [IT] Italy ..... MI91 A002333

[51] Int. Cl.[5] ..... B67D 5/40

[52] U.S. Cl. ..... 222/383; 239/333

[58] Field of Search ..... 222/207, 372, 382, 383, 222/481–484; 239/333

[56] References Cited

U.S. PATENT DOCUMENTS

| | | | |
|---|---|---|---|
| 4,153,203 | 5/1979 | Tada | 239/333 |
| 4,222,501 | 9/1980 | Hammett et al. | 222/207 |
| 4,958,754 | 9/1990 | Dennis | 222/383 |

*Primary Examiner*—Jesus D. Sotelo

*Attorney, Agent, or Firm*—Steinberg & Raskin

[57] ABSTRACT

For returning the trigger lever (15) connected to the pumping piston (13), two springs (19) are provided acting directly on the trigger lever (15) via one of their ends, at their other ends they being connected together and to a longitudinal bar-like element (21) carrying at one end a connector (23), which is connected to the delivery duct (18) of the device and to a nozzle (24), with which it defines a chamber (25) containing a delivery valve (26).

3 Claims, 2 Drawing Sheets

SPRAYER DEVICE COMPRISING A TRIGGER LEVER

This invention relates to an improved manually operated sprayer device connected in use to a container containing a liquid for the purpose of spray-dispensing this liquid, the device being of the type comprising means for its connection to the container, a body, a cylinder in said body, delivery and suction ducts in said body in communication with said cylinder, a piston slidingly mounted in the cylinder, a trigger lever rotatably supported in said body and connected to the piston, elastic return means acting between the trigger lever and the body, a suction valve, a delivery valve, and a nozzle receiving the liquid from the delivery duct.

A sprayer device of this type is known for example from U.S.A. Pat. No. 4,153,203 (TADA). In this known device the elastic return means consist of a substantially U-shaped metal wire spring. The negative aspects of this known construction are that this particular spring on the one hand determines a relatively complex and robust construction of the lever to which it is connected, and on the other hand is difficult to fit especially if this is to be done automatically (as would be required for mass production). In addition a metal spring involves ecological problems in that because it is of metal it must firstly be separated from the rest of the device (which is of plastics) when at the end of its life the device has to be disposed of by recycling or destruction.

The main object of the present invention is to provide a sprayer device of the aforesaid type which by using special expedients for the elastic means enables these means to be easily fitted, the lever structure to be simplified and the use of metal to be dispensed with, with consequent ecological advantages.

This and further objects which will be more apparent from the ensuing detailed description are attained by a sprayer device which is characterised essentially in that the elastic means form part of a single moulded plastics structure comprising two elastic arms which at one end are connected together and to an intermediate longitudinal element carrying at one end a connector for connection to the delivery duct and to the nozzle, with which it defines a chamber for containing the delivery valve.

This construction not only solves the ecological problem of the known construction, but also facilitates automatic fitting of the elastic return means in that this operation is reduced to mere linear insertion of the structure into the body of the device.

With this construction it is also possible to simplify the form of the lever in that it is no longer necessary to provide spring connection means, which are replaced herein by simple seats or supports present in the lever.

The invention will be more apparent from the detailed description given hereinafter by way of example with reference to the accompanying drawings, in which.

Figure 1:
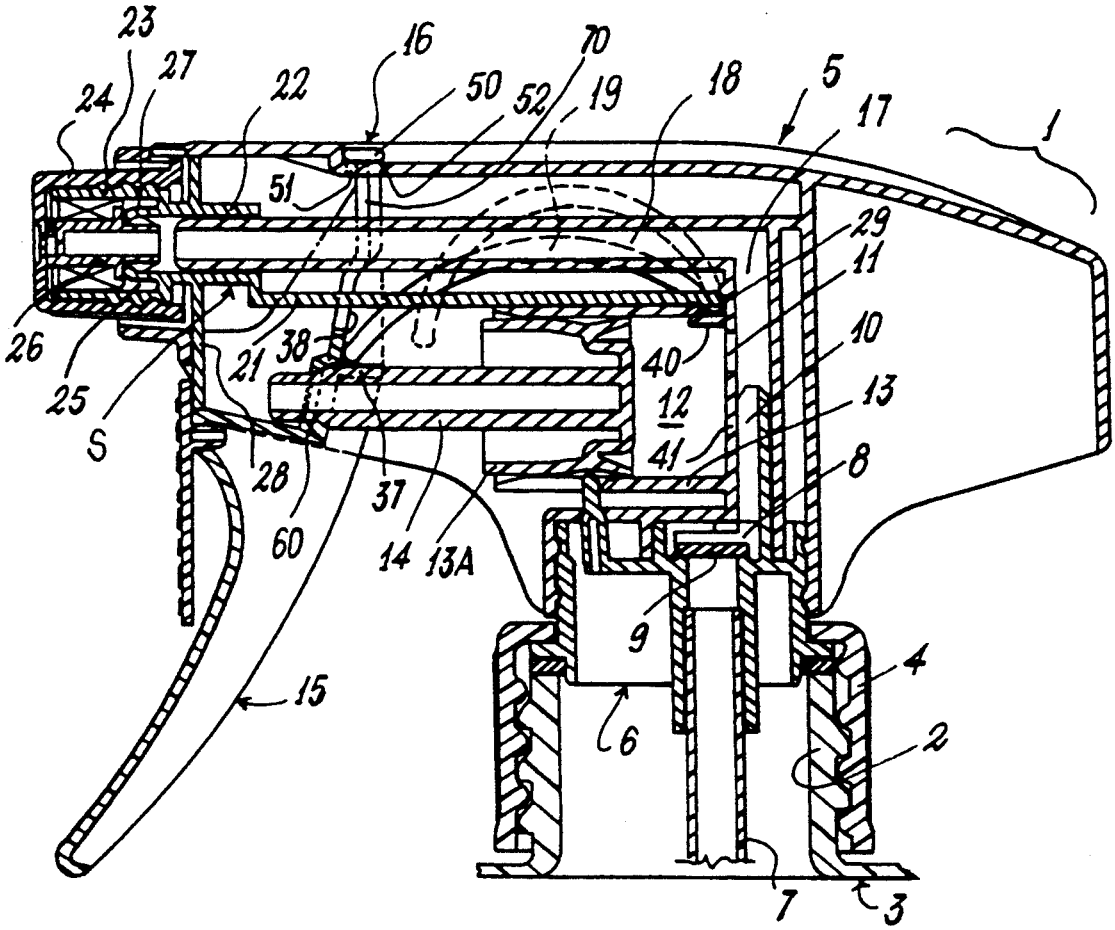
FIG. 1 is a longitudinal section through the sprayer device.
Figure 2:
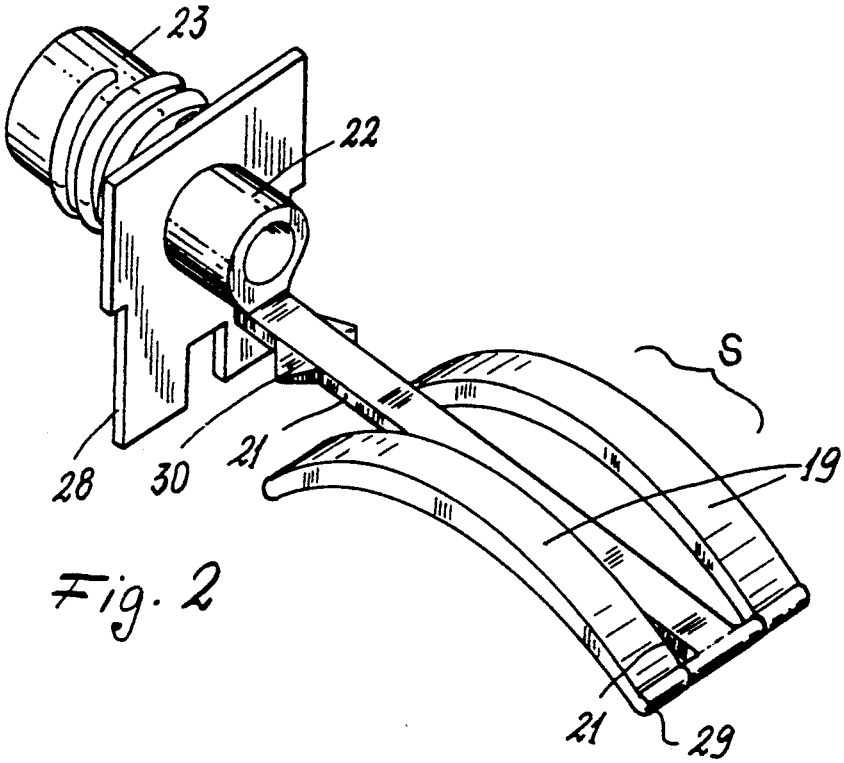
FIG. 2 is a perspective view of the structure comprising the return means springs.

In the figures the reference numeral 1 indicates the sprayer device, to be connected by a plastics screw cap 4 to the neck 2 of a container 3 containing the liquid to be sprayed. The sprayer device comprises a plastics body 5. In said body there is mounted a plastics insert 6 to which a plastics dip tube 7 is connected.

The insert 6 defines with the body 5 a valve chamber 8 containing the suction valve consisting of a plastics disc 9 for closing (and opening) the connection between the dip tube 7 and a suction duct 10 provided in the body 5. A port 11 opens into this duct from the pumping chamber 12 of a cylinder 13, which is formed within the body 5 and in which a plastics piston 13A is slidingly mounted. The piston 13A has a rod 14 secured within a toothed hole 60 of a plastics trigger lever 15. The trigger lever 15 is hinged at 16 to the body 5. For this purpose the upper end of the trigger lever 15 is in the form of a fork (of which only one arm 70 can be seen in FIG. 1). At the upper end of each arm there is a transverse head 50 which is inserted through an aperture 51 in the body 5, a tongue 52 extending into this aperture. The insertion is achieved with elastic displacement of the tongue, which then abuts against the underside of the head 50 part of which rests against a contour region of the aperture 51.

From the hole 11 there extends within the body 5 a delivery duct which, after a rising portion 17, comprises a terminal portion 18 parallel to the axis of the cylinder 12.

The return of the trigger lever and hence of the piston 13A is achieved by two identical arched springs 19 forming part of a single structure S (FIGS. 3 and 4) which is formed by moulding plastics material and comprises a longitudinal element 21 interposed between the two springs 19 and carrying at its free end a tubular appendix 22 which is forced over the end of the duct 19, and a threaded socket 23 to allow the screwed connection of a conventional spray nozzle 24 with which it defines a valve chamber 25 containing a conventional delivery valve acting as a mixer and sealing against an inner collar 27 of the structure in question during suction. A front wall 28 forms an integral part of this structure, to close the front of the body 5 of the sprayer device and lowerly provide a stop abutment for the trigger lever 15.

Figure 3:
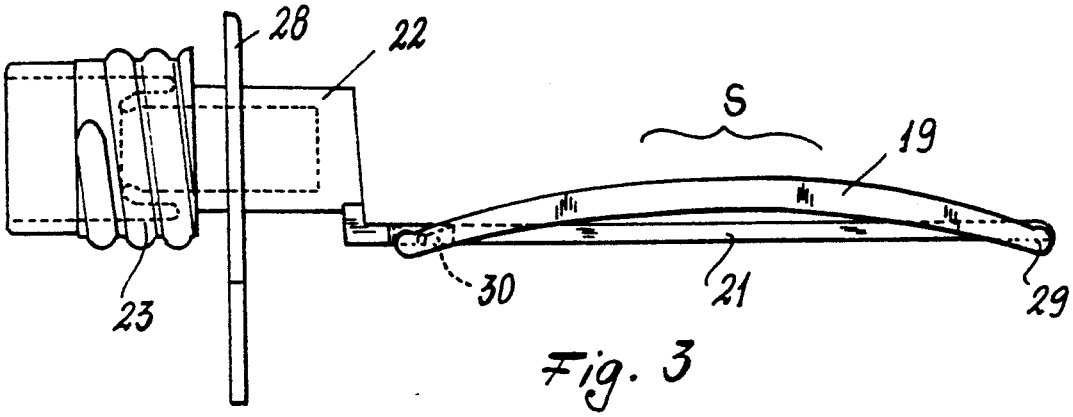
FIGS. 3 and 4 are a side and top view of the structure of FIG. 2 with parts shown in longitudinal section.
Figure 4:
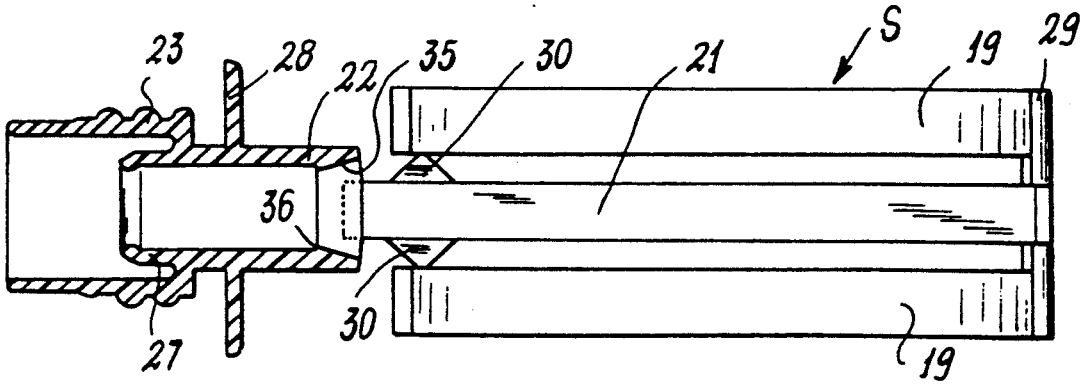

At one of their ends 29, the two springs 19 are joined together and to the longitudinal element 21. When the structure S is released from the mould and during its fitting into the body 5 its two springs are slightly curved as shown in FIG. 3 and are also joined to the longitudinal element 21 at their other end (see FIG. 4) by a tapering or triangular connection piece 30 which can be easily broken at the vertex at which it is connected to the springs.

It should be noted that the tubular appendix 22 comprises a conical mouth 35 (to facilitate its mounting onto the free end of the delivery duct 18), followed immediately by an annular step 36 which digs into the material of the duct 18 to ensure a sealed connection to this latter. To receive the free ends of the springs 19, the lever comprises on its rear side simple projecting supports 37 at the end of concave surfaces 38, the purpose of these being to guide these ends onto the supports when the trigger lever 15 is fitted into the body 5.

The sprayer device is assembled substantially in the following manner, although certain operations can be carried out in a different order.

The structure S is fitted into the body 5 by inserting it therein and forcing its tubular appendix 22 onto the end of the delivery duct and directing the ends 29 of the springs 19 onto supporting ledges or internal seats 40 provided in the body 5. The piston 13A is then inserted into the pumping chamber 12 until it comes into contact with the end wall 41. The trigger lever 15 is then inserted suitably inclined so that its two upper heads 50 pass through the apertures 51 provided in the body 5 and the free ends of the springs 19 slide along the guide surfaces 38 on the lever 15 and, in so doing, separate from the longitudinal element 21 (by breakage of the connection pieces 30) and move into the seats 37 on the lever. The lever 15 is then rotated in an anticlockwise direction so that the end of the rod 14 of the piston 13 penetrates through the internally toothed aperture 60 of the lever, where it remains fixed by virtue of the fact that the substantially saw-toothed toothing bites into the material of the rod.

The insert 6 with the suction valve and the nozzle 24 with the delivery valve 26 can then be inserted.

Further details of the lever/body and lever/piston connections can be obtained from a simultaneous patent application in the name of the present applicant.

I claim:

1. An improved manually operated sprayer device connected in use to a container (3) containing a liquid for the purpose of spray-dispensing this liquid, the device comprising means (4) for its connection to the container (3), a body (5), a cylinder (13) in said body, a delivery duct (17, 18) and a suction duct (10) in said body (5) in communication (11) with said cylinder (13), a piston (13A) slidingly mounted in the cylinder (13), a trigger lever (15) rotatably supported in said body (5) and connected to the piston (13A), elastic return means (19) acting between the trigger lever (15) and the body (5), a suction valve (9), a delivery valve (26), and a nozzle (24) receiving the liquid from the delivery duct (18), characterised in that the elastic return means (19) form part of a single moulded plastics structure (S) comprising, to constitute said elastic return means, two elastic arms (19) which at one end (29) are connected together and to an intermediate longitudinal element (21) carrying at one end a connector (22, 23) for connection to the delivery duct (18) and to the nozzle (24), with which it defines a chamber (25) for containing the delivery valve (26).

2. A sprayer device as claimed in claim 1, characterised in that the structure (S) comprises a wall (28) mounted on the connector (22, 23) for closing the body (5) and for halting the trigger lever (15).

3. A device as claimed in claim 1, characterised in that the connector (22, 23) is forcibly mounted onto the delivery duct (18).

* * * * *